United States Patent [19]

Tinus

[11] Patent Number: 4,685,738

[45] Date of Patent: Aug. 11, 1987

[54] SEAT REBUILDING

[76] Inventor: Edward J. Tinus, 511 Pierce St., Baltimore, Md. 21201

[21] Appl. No.: 770,264

[22] Filed: Aug. 28, 1985

[51] Int. Cl.[4] ..... A47C 7/02

[52] U.S. Cl. ..... 297/452; 160/DIG. 15

[58] Field of Search ..... 297/452; 5/471, 448, 5/478, 479, 402, 191, 190; 160/DIG. 15, 404; 24/265 C, 23 W

[56] References Cited

U.S. PATENT DOCUMENTS

| | | | |
|---|---|---|---|
| 2,444,873 | 7/1948 | Goldberg | 5/191 X |
| 2,520,325 | 8/1950 | Moore | 24/23 W |
| 2,789,629 | 4/1957 | Dewees | 5/478 |
| 3,298,741 | 1/1967 | Lepard, Jr. et al. | 297/452 X |
| 4,280,548 | 7/1981 | Brockman et al. | 160/DIG. 15 |

*Primary Examiner*—James T. McCall
*Attorney, Agent, or Firm*—Walter G. Finch

[57] ABSTRACT

The invention is an improved method and structure for rebuilding damaged and worn seats, such as seats for automotive equipment or vehicles. The structure of the present invention avoids the use of coil spring and "snake-like" wire springs in the rebuilding method and structure. The structure consists of a plurality of strap-like strips of steel or other suitable material woven into a net-like pattern with the ends thereof securely fastened around the existing seat frame. An alternative net-like pattern provides for a slight elevation of the control portion of the woven net-like pattern to provide an extra cushion effect.

6 Claims, 6 Drawing Figures

SEAT REBUILDING

BACKGROUND AND SUMMARY OF THE INVENTION

The invention relates to a method and structure for seat construction, and in particular to a method and structure for rebuilding damaged or worn seats. Specifically, it relates to a method and structure for rebuilding damaged or worn seats, such as, but not limited to, automotive type seats used in vehicles and other similar automative type equipment.

In the prior art of repairing damaged or worn seats, the spring system of the seats, such as coil springs or "snake-like" wire springs, have been merely been remounted or refastened in position by an improvised fastening means to the existing frame from which they have become detached or torn loose, or from which a portion of the coil spring or "snake-like" wire spring has disengaged from its mounting the seat frame.

Such repairs of the prior art have never been entirely satisfactory. The improvised fastening means subsequently becomes disengaged again, or the impaired fastening means causes the reused coil springs or "snake-like" wire springs to be out of alignment which in turn provides an uncomfortable and unsatisfactory seating facility. The present invention overcomes these problems.

The method and structure of the present invention consists of a plurality of strap-like strips of steel or other suitable material which is woven into a net-like pattern with the ends of each strap-like strip securely fastened and anchored to the existing seat frame.

An alternative net-like pattern provides for a slight elevation of the central portion of the woven net-like pattern, more or less like a bulged rise in the woven net-like portion. The ends of the strap-like strips are then securely fastened and anchored to the existing seat frame as in the previously described method and structure. This latter method and structure provides an extra cushion effect.

The old coil springs or "snake-like" wire springs are not reused in the present method and structure of rebuilding a seat.

After the spring-like structure of the present invention is in place, a suitable padding and a covering is placed over the spring-like structure and secured to it to complete the seat rebuilding procedure and structure. Such suitable padding may be what is termed "rubberized hoghair" with a foam-type rubber or plastics material cover over the "rubberized hoghair". The covering over this padding may be any of the available seat covering materials which exits.

Thus, a sturdy rebuilt seat has been provided by this invention which eliminates the unsatisfactory prior art method and structure of trying to remount and reuse the old coil springs and old "snake-like" wire springs.

It is, therefore, an object of this invention to provide a method and a structure for rebuilding seats.

It is also an object of this invention to provide a method and a structure for rebuilding automotive type seats.

It is another object of this invention to provide a method and structure for rebuilding seats that eliminates the remounting and reuse of old coil springs and old "snake-like" wire springs.

It is yet another object of this invention to provide a method and structure for rebuilding seats that uses strap-like strips of steel that are securely fastened to the seat frame in a net-like pattern to form the foundation for a rebuilt seat.

Further objects and advantages of the invention will become more apparent in light of the following description of the preferred embodiments.

DESCRIPTION OF THE PREFERRED EMBODIMENTS

Figure 1:
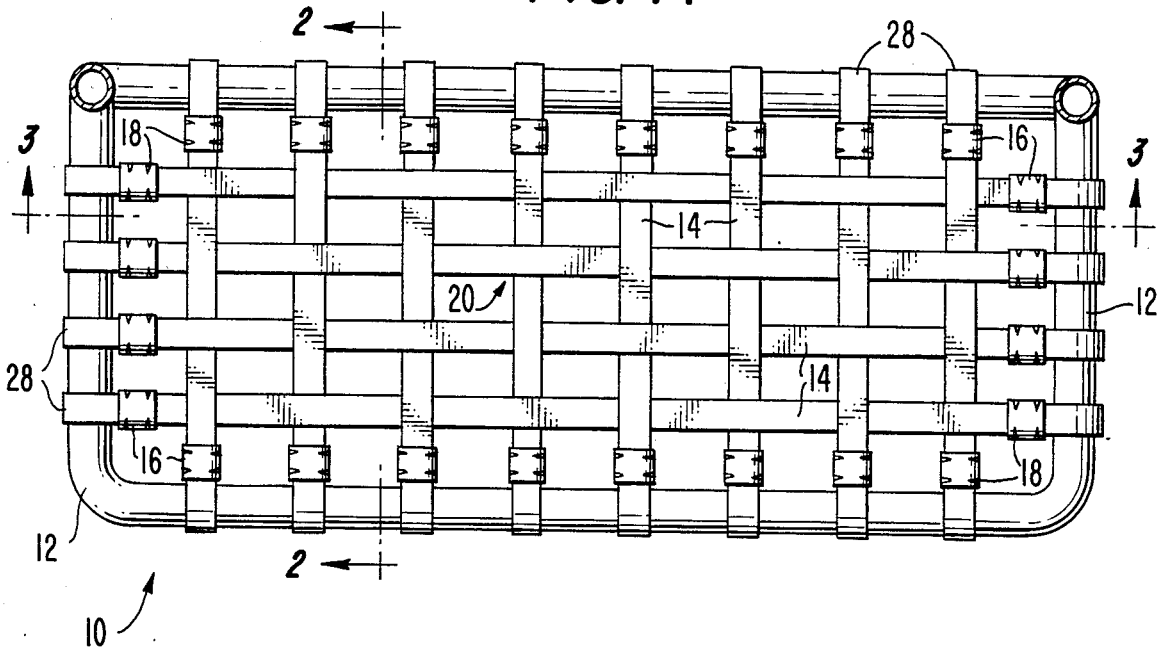
FIG. 1 is a plan view of a first embodiment of a rebuilt seat, without padding or covering.
Figure 2:
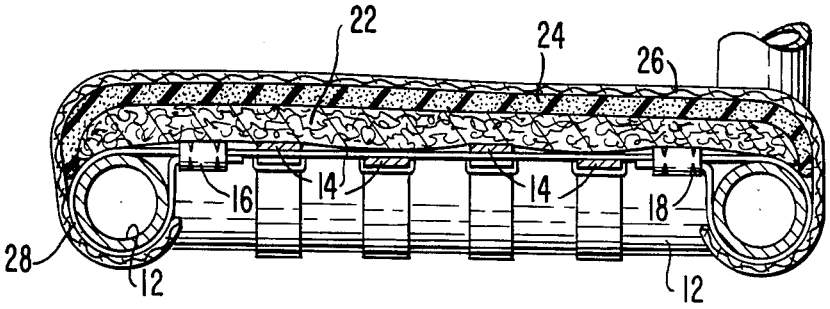
FIG. 2 is a transverse cross-section of FIG. 1 on line 2—2, showing padding and covering.
Figure 4:
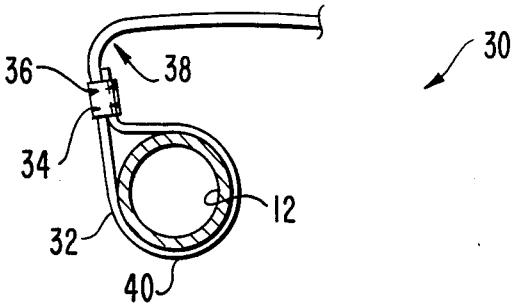
FIG. 4 is a partial cross-section of a second embodiment of a rebuilt seat, without padding or covering.
Figure 3:
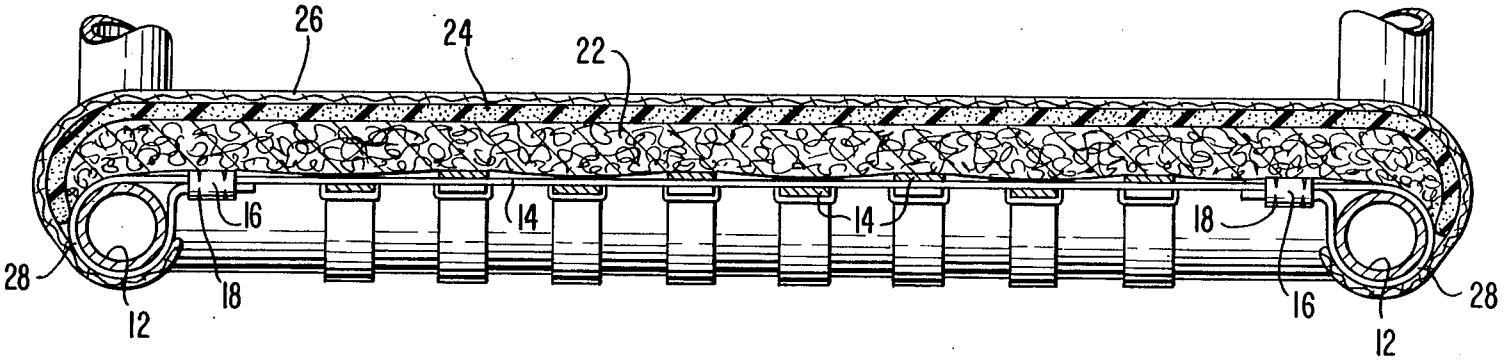
FIG. 3 is a longitudinal cross-section of FIG. 1 on line 3—3, showing padding and covering.
Figure 6:
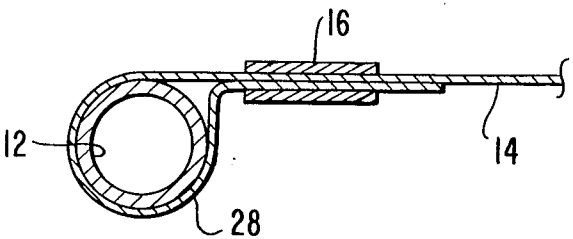
FIG. 6 is an enlarged cross-section view of FIG. 5 on line 6—6.
Figure 5:
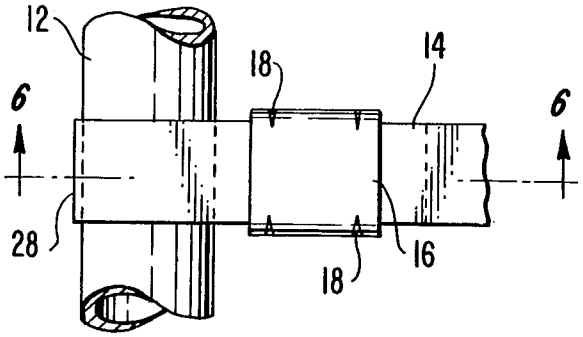
FIG. 5 is an enlarged plan view of a strap connection with a seat frame.

Referring now to the drawings, and particularly to FIGS. 1 and 4, a first embodiment of seat rebuilding is shown in FIG. 1 at 10 and a second embodiment of seat rebuilding is shown in FIG. 4 at 30. The first embodiment of seat rebuilding 10 will be described first, followed by the second embodiment of seat rebuilding 30.

The seat rebuilding 10 is shown for a typical automotive type seat frame 12. It is to be understood, however, that the invention for seat rebuilding 10 may be used on other types of seat frames.

The seat rebuilding 10 consists of a plurality of straps 14 and a plurality of sleeve-like clamps 16. The plurality of straps 14 are looped 28 at their ends around the typical seat frame 12 and each end of the strap 14 is secured with a sleeve-like clamp by crimping 18 the sleeve-like clamps 16, thus securing the end of the strap 14 to itself where it is looped 28 around the typical seat frame 12. The sleeve-like clamp 16 encircling the strap 14, including the end of strap 14 after it is looped 28 around the seat frame 12. Thus, the strap 14 passes through the sleeve-like clamp 16 twice before it is crimped 18.

Either the transverse or the longitudinal straps 14 may be installed on the typical frame first, and then the other opposite direction straps 14 are installed in a woven pattern 20 with the ends secured to the typical seat frame 12 with sleeve-like clamps 16 by crimping 18 as described hereinbefore.

After the woven pattern 20 of the straps 14 has been installed on the typical seat frame 12 and each is secured by the sleeve-like clamps 16 by crimping 18, the seat rebuilding is ready for finishing.

First a cushion padding 22, such as rubberized horsehair, is placed over and suitably affixed to the woven pattern 20 of straps 14, then a securing padding 24, such as a foam type rubber, or foam type plastics, is placed over and suitably affixed to the cushion padding 22. Over this combined padding of the cushion padding 22 and the securing padding 24 a cloth type covering 26 is drawn tightly and suitably secured in place by sewing, tying, and other similar means to said securing padding and the underside of said woven pattern 20 of said straps 14.

The second embodiment of seat rebuilding 30 is installed in a similar manner as the first embodiment of seat rebuilding 10, except that a bulge 38 is built into the formation of the pattern. The second embodiment of seat rebuilding 30 has a plurality of straps 32 and a plurality of sleeve-like clamps 34, the straps 32 are looped 40 around the typical seat frame 12 as described for the first embodiment of seat rebuilding 10, woven into a pattern as described for the first embodiment of seat rebuilding 10, then clamped 34 and crimped 36. During the looping 40 and wearing of the straps 32 the bulge 38 is built into the pattern to provide additional cushion effect to the seat rebuilding 30.

The bulge in the longitudinal and transverse straps 32 is caused by the design of the tubular or sheet metal frame which support these straps. If the frame is flat, the straps 32 would conform to the tubular frame. However, if the frame is formed arcuate, the straps 32 are likewise formed arcuate so as to form the bulge in the straps 32 to give a bucket-like effect.

In the second embodiment of seat rebuilding 30 a cushion padding 22, a securing padding 24, and a covering 26 are added in the same manner as in the first embodiment of seat rebuilding 10.

As can be readily understood from the foregoing description of the invention, the present structure can be configured in different modes to provide the ability to rebuild seats.

Accordingly, modifications and variations to which the invention is susceptible may be practiced without departing from the scope and intent of the appended claims.

What is claimed is:

1. A method for rebuilding seats having cushions comprising, installing a plurality of strap means in a transversal direction on a typical seat frame, looping the ends of said transverse strap means over portions of said seat frame, securing said transversal strap means by clamping said looped ends with a clamp means, crimping said clamp means, installing a plurality of strap means in a longitudinal direction on said typical seat frame by weaving said longitudinal strap means into a woven pattern through and around said transverse strap means, securing said longitudinal strap means by looping the ends of said longitudinal strap means over portions of said seat frame, clamping and crimping a clamp means over said looped ends thereof, placing a cushion padding over said woven pattern of transverse and longitudinal strap means, placing a securing padding over said cushion padding, securing said cushion padding, securing padding in place with a covering means, and adding a bulge to said transverse and said longitudinal strap means above said looping of said transverse and said longitudinal around said typical seat frame so that said strap means permit said cushions to provide an additional cushion effect.

2. A rebuilt seat means, comprising:

a plurality of transverse strap means having a cushion, each said transverse strap means of said plurality of transverse strap means having a first end and a second end, said first and second ends of said plurality of transverse strap means being suitably looped around a portion of a typical seat frame;

a plurality of longitudinal strap means, each said longitudinal strap means of said plurality of longitudinal strap means having a first end and a second end, said first and second ends of said plurality of longitudinal strap means being suitably looped around a portion of said typical seat frame, said plurality of longitudinal strap means being formed and set into a woven pattern with said plurality of transverse strap means;

a plurality of clamp means, said plurality of clamp means being located at and upon each said first end and each said second end of said plurality of transverse and said longitudinal strap means to secure said plurality of transverse and said plurality of longitudinal strap means in place upon said typical seat frame, and a bulge configuration in each said first and second end of each said transverse and longitudinal strap means so that said strap means permit said cushions to provide an additional cushion effect before each said clamp means is crimped to securely affix it in place around said strap means.

3. A rebuilt seat means as recited in claim 2, wherein each said clamp means of said plurality of clamp means is sleeve-like in configuration.

4. A rebuilt seat means as recited in claim 3, wherein each said first end and said second end of each said transverse and said longitudinal strap means is passed through its respective said sleeve-like clamp means twice to complete said loop.

5. A rebuilt seat means as recited in claim 4, wherein each said clamp means on each said first and second clamp means and of each said transverse and each said longitudinal strap means is crimped to securely affix it in place around said strap means.

6. A rebuilt seat means as recited in claim 5, and additionally a cushion padding means, a securing padding means, and a cover means, said cushion padding means being suitably affixed to and over said woven pattern of said transverse and said longitudinal strap means, said securing padding means being suitably affixed to and over said cushion padding means, said covering means being suitably affixed to and over said securing padding means and additionally suitably affixed around portions of said typical seat frame means and to the undermost side of said woven pattern of said transverse and said longitudinal strap means.

* * * * *